US009738427B2

(12) United States Patent
Backes et al.

(10) Patent No.: US 9,738,427 B2
(45) Date of Patent: Aug. 22, 2017

(54) COMPOSITE PACK HAVING A POURING ELEMENT, AND BLANK FOR PRODUCING SUCH PACK

(71) Applicant: SIG Technology AG, Neuhausen am Rheinfall (CH)

(72) Inventors: Martin Backes, Heinsberg (DE); Hansjörg Huber, Radolfzell (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 0 days.

(21) Appl. No.: 14/408,657

(22) PCT Filed: Jun. 28, 2013

(86) PCT No.: PCT/EP2013/063642

§ 371 (c)(1),
(2) Date: Dec. 17, 2014

(87) PCT Pub. No.: WO2014/001507

PCT Pub. Date: Jan. 3, 2014

(65) Prior Publication Data

US 2015/0144630 A1 May 28, 2015

(30) Foreign Application Priority Data

Jun. 29, 2012 (DE) ..... 10 2012 012 937

(51) Int. Cl.
*B65D 51/22* (2006.01)
*B65D 5/74* (2006.01)

(52) U.S. Cl.
CPC ..... *B65D 51/222* (2013.01); *B65D 5/742* (2013.01); *B65D 5/747* (2013.01); *B65D 5/748* (2013.01)

(58) Field of Classification Search
CPC ..... B65D 51/222; B65D 5/748; B65D 5/742; B65D 5/747
USPC ..... 229/125.14, 125.15; 222/81, 87, 153.06; 220/277, 278, 258.4, 265, 266, 267, 62; 215/250, 257
See application file for complete search history.

(56) References Cited

U.S. PATENT DOCUMENTS 5,482,176 A 1/1996 Maietta et al.
6,041,968 A * 3/2000 Weiteder ..... B65D 5/748 222/545

(Continued)

FOREIGN PATENT DOCUMENTS

CN 1250418 A 4/2000
EP 1091879 B1 11/2002

(Continued)

*Primary Examiner* — Robert J Hicks
*Assistant Examiner* — Kareen Thomas
(74) *Attorney, Agent, or Firm* — The Webb Law Firm

(57) ABSTRACT

A pack having an opening region provided in the top of the pack which forms a pouring opening after it is cut through by an applied pouring element, the pouring element including a base body, a cutting element arranged movably therein, and a screw cap, the screw cap being used for first opening of the pack by actuating the cutting element and for reclosure, and the opening region having a weakened line. The weakened line has a round first section and a second section. The first time the composite pack is opened by moving the cutting element, the weakened line is cut in the first section and tears in the second section.

11 Claims, 2 Drawing Sheets

(56) References Cited

U.S. PATENT DOCUMENTS

| | | | | |
|---|---|---|---|---|
| 6,223,924 | B1 * | 5/2001 | Ek | B65D 5/748 215/230 |
| 6,364,164 | B1 * | 4/2002 | Troiano | B65D 5/748 220/278 |
| 6,382,462 | B1 * | 5/2002 | Ostergaard-Nielsen | B65D 5/749 222/1 |
| 6,745,923 | B2 * | 6/2004 | Julian | B65D 5/748 220/255.1 |
| 6,851,576 | B2 | 2/2005 | Dubach | |
| 7,207,465 | B2 | 4/2007 | Weist | |
| 7,540,405 | B2 * | 6/2009 | Sase | B65D 5/748 220/277 |
| 2010/0018992 | A1 | 1/2010 | Dill et al. | |

FOREIGN PATENT DOCUMENTS

| | | | |
|---|---|---|---|
| EP | 1509456 | B1 | 6/2006 |
| EP | 1399366 | B1 | 10/2006 |
| EP | 1623931 | B1 | 10/2008 |
| EP | 2125542 | B1 | 7/2011 |
| EP | 2287082 | B1 | 4/2012 |
| WO | 2006000881 | A2 | 1/2006 |
| WO | 2010128302 | A1 | 11/2010 |

* cited by examiner

COMPOSITE PACK HAVING A POURING ELEMENT, AND BLANK FOR PRODUCING SUCH PACK

CROSS-REFERENCE TO RELATED APPLICATIONS

This application is the United States national phase of International Application No. PCT/EP2013/063642 filed Jun. 28, 2013, and claims priority to German Patent Application No. 10 2012 012 937.8 filed Jun. 29, 2012, the disclosures of which are hereby incorporated in their entirety by reference.

BACKGROUND OF THE INVENTION

Field of the Invention

The invention relates firstly to a composite pack, in particular a parallelepipedal cardboard/plastic composite pack for flowable products, having an opening region provided in the top of the pack which forms a pouring opening after it is cut through by an applied pouring element, the pouring element comprising a base body, a cutting element arranged movably therein, and a screw cap, the screw cap being used for first opening of the pack by actuating the cutting element and for reclosure, and the opening region having a weakened line in the composite and a hinge region, on which the part of the opening region formed after the weakened line is cut through is tilted into the interior of the pack and held there. The invention furthermore relates to a blank made of cardboard/plastic composite material for producing such a pack, and to a pouring element for use with such a pack.

Description of Related Art

Composite packs having pouring elements, which are also used for first opening, are known in practice in a wide variety of variants. The composite material comprises at least one carrier layer made of cardboard, and respectively polyethylene layers sealed on externally, which protects the cardboard against moisture. Since the thin PE films are highly extensible, it is generally not readily possible to apply pouring elements, which are provided with a cutting element, at an arbitrary position on the pack without prior introduction of weakened regions.

It is therefore known to prepare the cardboard/plastic composite packs in question in such a way that a weakened line is formed there, while being adapted to the geometry and size of the pouring element to be used, in order to achieve clean, easy and reliable cutting out of a part of the pack wall during first opening, so as to form the pouring opening. To this end, it is known to introduce so-called weakened lines into the outer layers of the pack material, which in conjunction with the cutting element ensure that easy, reliable and full separation takes place.

So that the cut-out part of the pack cannot interfere with the pouring process, it should on the one hand not be cut out fully and thus enter the product, and on the other hand it should not fold back and thus fully or partially close the pouring opening.

A composite pack of this type is known from EP 1 623 931 B1. In this case, the first time the screw cap is actuated (unscrewed), a cutting element arranged inside the pouring element is set in movement in such a way that it cuts a round pouring opening out of the composite material of the pack along a prepared weakened line. A projection extending into the circular weakened region ensures that the part cut out is not fully separated from the composite material, and it is simultaneously used as a hinge in order to tilt the cut-out part into the interior of the pack.

EP 1 399 366 B1 discloses a closure device with a piercing element, which is used for opening a composite pack according to the preamble of Claim 1. In this case, the opening line extends in a circle, the opening process being influenced by the choice of an offset angle $\alpha$, so as to ensure that a region not yet cut through is folded to the side during opening, without the composite material being torn in this region.

It is also known to weaken the future pouring openings by stamping a hole into the cardboard before the lamination, this hole then being reclosed on both sides by the PE layer during the lamination ("prelaminated hole"). In this case, only the PE material remains to be cut out by the pourer. A disadvantage with this is that the partially cut-out part of the PE layers is not rigid, and therefore remains in the pack in an undefined way, so that problems may occur during the pouring process.

In order to overcome this problem, according to the teaching of EP 2 287 082 A1, the prelaminated hole is no longer formed circularly, but for example is formed as a "C", in order to provide a material bridge that is as wide as possible, which allows the separated part to be tilted in a defined way into the interior of the pack and fixed there.

It has also already been proposed to use asymmetrical weakened lines, in which case the weakened line extends in a spiral and a material bridge which can be used as a hinge is therefore formed between the ends of the line (WO 2006/000881 A2).

SUMMARY OF THE INVENTION

On the basis of this, it is the object of the present invention to configure and refine the composite pack mentioned in the introduction and described in detail above in relation to its opening region, in such a way that easy and reliable opening and keeping open of the pouring opening can straightforwardly be achieved the first time the self-opening pouring element is actuated. Such a composite pack should be as versatile as possible, i.e. usable even in the aseptic field and also for packaging sensitive products, for example orange juice, in which the composite laminate also contains an oxygen barrier layer, for example aluminium.

In the case of a composite pack having the features of the preamble of Claim 1, this object is achieved in that the hinge region is formed by a straight line, the weakened line has a round first section and a second section, which extends essentially straight between the first section and the hinge region, and in that, the first time the composite pack is opened by moving the cutting element, the weakened line is cut in the first section and tears in the second section.

In a blank made of cardboard/plastic composite material for producing such a composite pack, the object is achieved in that at least one layer is weakened by a perforation or the like in the opening region by means of weakened lines applied or introduced.

In order to achieve the object in relation to a pouring element comprising a base body, a cutting element arranged movably therein, and a screw cap, the cutting element executes the rotation of about 360° the first time the pouring element is opened, and has a cutting spike which cuts through the opening region of the pack along the weakened line when the screw cap is actuated, and tilts the part of the opening region formed after the weakened line is cut through into the interior of the pack and holds it in this position. A corresponding pouring element is known per se from EP 1 509 456 B1 in the name of the Applicant.

The invention straightforwardly achieves the effect that, during first opening, a pouring opening is formed which has an area greater than the internal cross section of the pouring spout, and in which, owing to the defined tilting of the cut-out part of the composite material into the interior of the pack, on the one hand inadvertent release of this part is reliably prevented, and on the other hand the pouring opening can no longer be interfered with during the pouring process. The full cross section of the pouring element is thus available for the pouring.

Because the hinge region is formed by a straight line, a defined hinge axis can be achieved. To this end, the hinge region may also be also weakened in at least one layer of the composite material, for example by means of a perforation or the stamping or grooving of a bending line, in order to further facilitate the tilting process, and therefore also the opening process.

In another configuration of the invention, the first section of the weakened line adjoins the hinge region in continuation thereof, so that the hinge region is formed not centrally with respect to the pouring opening, but laterally offset.

According to a further teaching of the invention, the first section of the weakened line approximately describes three-quarters of a circle. It has been found that defined cutting over three-quarters of a circle is sufficient to facilitate the subsequent process of tilting the partially cut-out part. Expediently, in this case, the end of the second section of the weakened line extends as far as the free end of the hinge region, so that during further movement of the cutting spike of the cutting element, the composite material tears along this second weakened line and the cutting spike can be used to tilt the partially cut-out part of the composite material into the interior of the pack.

According to a particularly preferred configuration of the invention, the first section of the weakened line describes a circle arc of 270°. In this way, not only the circular cross section below the cutting path of the cutting element, but also an approximately triangular region ("gusset") adjacent thereto as far as the hinge, within a closed contour of the weakened line, is exposed in order to form the pouring opening.

According to another configuration of the invention, the angle between the hinge region and the end of the second section of the weakened line is a right angle or obtuse angle. The effect achieved by such a geometrical specification is that the second section of the weakened line tears reliably while the cutting spike of the cutting element carries out the process of tilting the separated part into the interior of the pack.

Expediently, the weakened lines are produced by a laser. In this case, it has proven particularly useful to introduce perforated cuts into one or more layers of the composite material. As an alternative, however, it is also possible to produce the weakened lines mechanically as stamped or grooved lines.

BRIEF DESCRIPTION OF THE DRAWINGS

The invention will be explained in more detail below with the aid of a drawing, which merely represents a preferred exemplary embodiment. In the drawing.

DETAILED DESCRIPTION OF THE INVENTION

Figure 1:
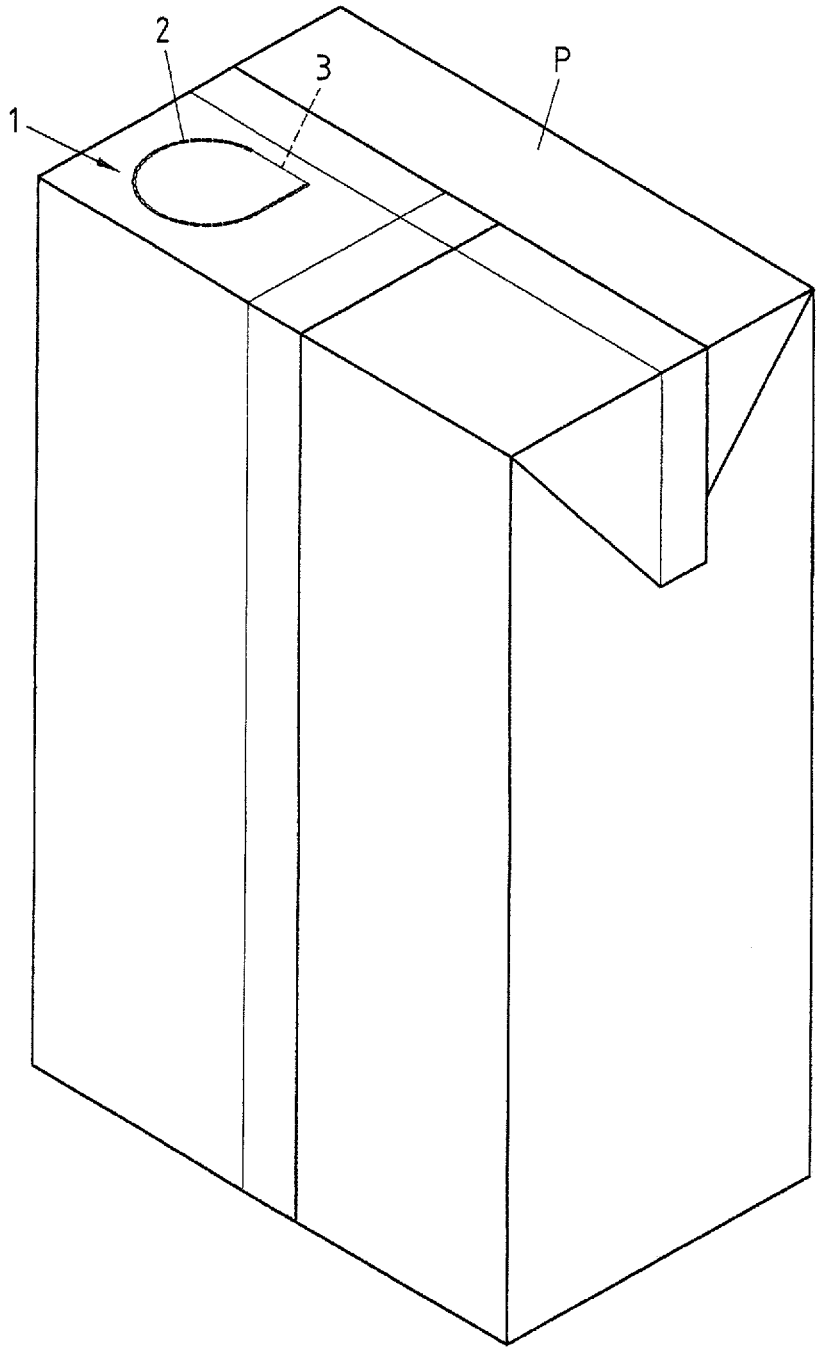
FIG. 1 shows a composite pack according to the invention without the pouring element applied, in a perspective view.

FIG. 1 shows a composite pack P, as long known per se as a parallelepipedal cardboard/plastic composite pack for pourable products. In order to achieve a clean-cut pouring opening, the composite material in the opening region 1 of the pack is provided with a weakened line 2, which extends from one end of a hinge region 3 to its other end.

Figure 2:
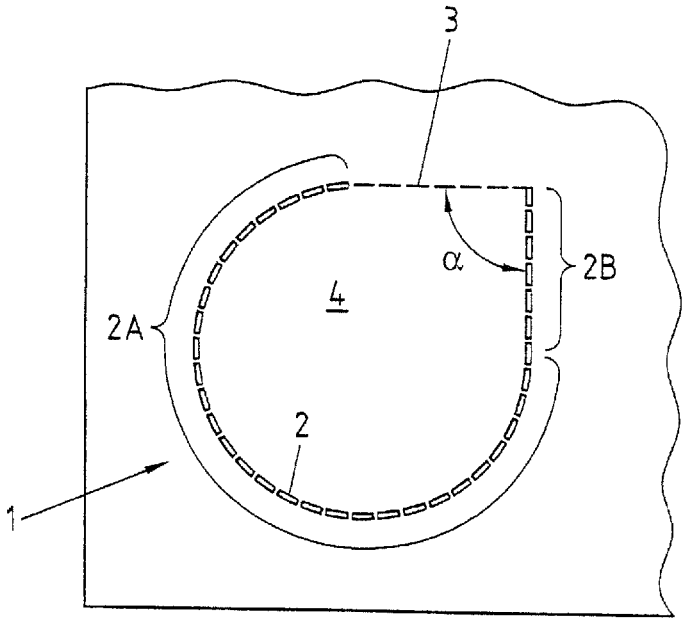
FIG. 2 shows the opening region of the composite pack of FIG. 1 in enlarged plan view.

From the enlargement in FIG. 2, it is more clearly revealed that the weakened line 2 has a curved first section 2A and merges into a second section 2B, which extends between the first section 2A and the hinge region 3. The hinge region 3 and the second region 2B of the weakened line make an angle $\alpha$, which in the exemplary embodiment represented and to this extent preferred is 90°. It is not represented that the first section may also comprise a circle arc which is greater than 270°, so long as the remaining hinge region remains sufficiently large in order to form a stable bridge between the composite material and the separable section 4.

In order to facilitate the tilting process, the hinge region 3, which in the present and to this extent preferred exemplary embodiment is described as a straight line, may also be weakened by means of a further weakened line.

The opening process is carried out in such a way by an applied pouring element with a cutting element 5 and a screw cap 6 (FIG. 3) during first actuation of the screw cap 6 a cutting spike 7 of the cutting element 5 penetrates into the composite material in the region of the weakened line 2, and is then guided anticlockwise on a circular path around the separable part 4. After reaching a rotation of about 270°, the second section 2B "leaves" the weakened line 2 of the circular cross section tangentially outwards, but by the further circular movement of the cutting spike 7 the second section 2B of the weakened line 2 also tears.

Figure 3:
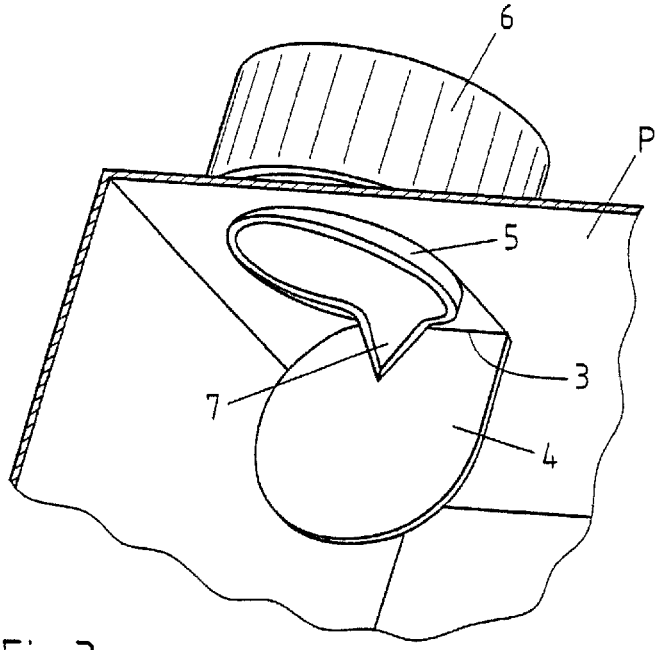
FIG. 3 shows a composite pack according to the invention with the pouring element applied, after a first opening and reclosure of the screw cap, for better representation in a cutaway perspective view.

The cutting spike 7 acts as a guide element, in order to initiate the tilting movement of the part 4 of the composite material into the interior of the pack, and to end it only when the separated part 4 has extended by about 90° into the interior of the pack. This state is shown in FIG. 3, in which the cutting spike 7 has reached its end position, which it no longer changes even after further actuation of the screw cap 6 in the rotation direction.

Many pouring elements known per se are formed in such a way that, the first time the screw cap is screwed on, the cutting element moves even further into the interior of the pack in order to achieve reliable blocking of the part extending into the interior of the pack and therefore to reliably keep the pouring opening open. Such a pouring element may preferably also be used with the composite pack according to the invention.

The invention claimed is:

1. A composite pack, comprising an opening region provided in a top of the pack which forms a pouring opening after the top of the pack is cut through by an applied pouring element, the pouring element comprising a base body, a cutting element arranged movably therein, and a screw cap, the screw cap being used for first opening of the pack by actuating the cutting element and for reclosure, and the opening region having a weakened line in a composite and a hinge region, on which a part of the opening region formed after the weakened line is cut through is tilted into an interior of the pack and held there, wherein the hinge region is formed by a straight line, the weakened line has a round first section and a second section, which is directly connected to and extends essentially straight between the first section and the hinge region, the hinge region and the second section extending substantially perpendicular to one another, such that, a first time the composite pack is opened by moving the cutting element, the weakened line is cut in the first section and tears in the second section.

2. The composite pack according to claim 1, wherein the hinge region is also weakened in at least one layer of a composite material.

3. The composite pack according to claim 1, wherein the first section of the weakened line adjoins the hinge region in continuation thereof.

4. The composite pack according to claim 1, wherein the first section of the weakened line approximately describes three-quarters of a circle.

5. The composite pack according to claim 1, wherein an end of the second section of the weakened line extends as far as a free end of the hinge region.

6. The composite pack according to claim 4, wherein the first section of the weakened line describes a circle arc of 270°.

7. The composite pack according to claim 5, wherein an angle between the hinge region and the end of the second section of the weakened line is a right angle or obtuse angle.

8. The composite pack according to claim 1, wherein the weakened line is produced by a laser.

9. The composite pack according to claim 1, wherein the weakened line is produced mechanically as stamped or grooved lines.

10. A blank made of cardboard/plastic composite material for producing composite packs according to claim 1, wherein the composite is weakened by a perforation in an opening region by means of weakened lines applied or introduced.

11. The pouring element for use with the composite pack according to claim 1, the pouring element comprising the base body, the cutting element arranged rotatably therein, and the screw cap, for use with the composite pack, wherein the cutting element executes a rotation of about 360° a first time the pouring element is opened, and has the cutting spike which cuts through an opening region of the pack along the weakened line when the screw cap is actuated, and tilts the part of the opening region formed after the weakened line is cut through into the interior of the pack and holds the part of the opening region in the tilted position.

* * * * *